US006679722B1

(12) United States Patent
Pulizzi

(10) Patent No.: US 6,679,722 B1
(45) Date of Patent: Jan. 20, 2004

(54) CONNECTOR RESTRAINT DEVICE FOR ELECTRICAL EQUIPMENT

(75) Inventor: Peter S. Pulizzi, Fountain Valley, CA (US)

(73) Assignee: Pulizzi Engineering, Inc., Santa Ana, CA (US)

( * ) Notice: Subject to any disclaimer, the term of this patent is extended or adjusted under 35 U.S.C. 154(b) by 0 days.

(21) Appl. No.: 10/106,618

(22) Filed: Mar. 26, 2002

(51) Int. Cl.[7] ..... H01R 13/58; H01R 9/22

(52) U.S. Cl. ..... 439/451; 439/719

(58) Field of Search ..... 439/451, 719, 439/371, 471, 713; 248/499, 500, 73, 74.3; 385/134, 135; 174/59, 60

(56) References Cited

U.S. PATENT DOCUMENTS

| | | | | | |
|---|---|---|---|---|---|
| 3,802,654 | A | * | 4/1974 | Jenko et al. | 248/73 |
| 4,641,225 | A | * | 2/1987 | Reochle | 361/829 |
| 5,575,665 | A | * | 11/1996 | Shramawick et al. | 439/713 |
| 5,731,546 | A | * | 3/1998 | Miles et al. | 439/449 |
| 5,765,698 | A | * | 6/1998 | Bullivant | 361/826 |
| 5,775,956 | A | * | 7/1998 | Sticker et al. | 439/719 |
| 5,954,301 | A | * | 9/1999 | Joseph et al. | 248/68.1 |
| 6,086,415 | A | * | 7/2000 | Sanchez et al. | 439/719 |
| 6,396,992 | B1 | * | 5/2002 | Debal | 385/135 |
| 6,398,569 | B1 | * | 6/2002 | Boyd et al. | 439/369 |
| 6,468,112 | B1 | * | 10/2002 | Follingstad et al. | 439/719 |
| 6,498,293 | B2 | * | 12/2002 | Marchand et al. | 174/50 |
| 6,568,542 | B1 | * | 5/2003 | Chen | 385/135 |

OTHER PUBLICATIONS

Powertrouics Drawing No. PTS–E–M–OTCTBA05–00 dated Jul. 10, 2001.

Unicom Cable Management Web pp. 1–4 particularly Part No's. RPM–AMIOOB–01 and RPM–AM200b–01.

* cited by examiner

*Primary Examiner*—P. Austin Bradley
*Assistant Examiner*—Briggitte R Hammond
(74) *Attorney, Agent, or Firm*—Howard R. Lambert

(57) ABSTRACT

A connector restraint device is disclosed for restraining electrical wire end connectors plugged into connectors installed in a wall of an electrical equipment enclosure, and for tying down electrical wires attached to the electrical wire end connectors. The connector restraint device includes a base portion to which is joined an elongate wire support and tie-down angle having a horizontal leg and a vertical leg depending from the horizontal leg. Each of the horizontal and vertical legs are formed having a number of closely spaced square apertures along the legs, the apertures being sized for receiving conventional wire ties. Further disclosed are connector restraint device side flanges joined to ends of the device base portion for detachably attaching the angle to the enclosure with the wire support and tie-down angle parallel to and spaced about three inches away from the enclosure wall in which the connectors are installed and with the horizontal leg parallel to the enclosure wall in which the connectors are installed at the height of the connectors so that electrical wires connected to the connectors can be extended generally horizontally over the horizontal leg. The wire support and tie-down angle is formed so that the vertical leg depends from an edge of the horizontal leg that is closest to the enclosure when the angle is attached to the enclosure. Both rear-mount and front-mount connector restraint devices are disclosed for when enclosure-mounted connectors are installed in the enclosure rear wall or front wall.

21 Claims, 5 Drawing Sheets

CONNECTOR RESTRAINT DEVICE FOR ELECTRICAL EQUIPMENT

BACKGROUND OF THE INVENTION

1. Field of the Invention

The present invention relates generally to the field of electrical (including electronic) equipment, more particularly to external electrical wires (including cables and power cords) connected to such equipment, and still more particularly to connector restraints associated with such external electrical wires.

2. Background Discussion

Known electrical power output equipment, such as AC power distributors and power controllers, are constructed for providing electrical power to other electrical equipment which may include power supplies, computers, printers and disc drives. To accomplish this, typical AC electrical power output equipment has installed in an equipment enclosure wall—usually the rear wall—several, often as many as eight, AC electrical outlet connectors into which can be plugged various external AC electrical equipment for receiving electrical power from the power output equipment.

The electrical power output equipment typically has installed in the equipment's same enclosure wall an AC electrical input connector into which a power cord is plugged for supplying power, for example, from an external power strip or directly from a power utility outlet, to the power output equipment and thus to the other electrical equipment plugged into the AC power outlet connectors. Illustrative of such AC power output equipment is the model TPC 884-1 power controller, manufactured by Pulizzi Engineering Inc. of Santa Ana, Calif., which has a single AC power inlet connector and a row of eight closely-spaced IEC-type AC power outlet connectors in an enclosure rear wall.

Ordinarily, AC power output equipment is installed in a conventional equipment rack along with other electrical equipment, for example, equipment connected by power cords or power cables plugged into the power output equipment for being powered thereby.

It can be appreciated that the rear region of most equipment racks are, therefore, typically draped with numerous, often entangled power cords, at least some of which may be relatively long and thus relatively heavy in weight. As a result of personnel working behind the equipment racks to install, remove, interconnect or service equipment in the racks some of the power cords are often accidentally dislodged from their associated equipment. In addition, the weight of some power cords may cause them to become unplugged by themselves, especially if the equipment racks are located in an environment subject to vibration, as in many airborne and ship applications.

In this regard it should be noted that because of usual space limitations neither input or output AC power connectors nor the power cords plugged into them are ordinarily provided with any integral locking mechanism, such as the locking screws or clips associated with many computer and printer interconnecting cable plugs.

Because of the often large number of pieces of electrical equipment mounted in the equipment racks and the associated often large number of power cords powering all the equipment, the proper reconnection of loose power cords is often a problem and some reconnection mistakes, resulting in equipment malfunction, may be expected to occur.

It is, therefore, a principal objective of the present invention to provide for connector restraint to prevent unintended disconnection of power cords or the like from the electrical equipment and also for managing power cords or wires that supply power to and receive power from, or otherwise connect to, associated electrical equipment.

SUMMARY OF THE INVENTION

In accordance with the present invention there is provided a connector restraint device for restraining electrical wire end connectors plugged into connectors installed in an electrical equipment enclosure wall, and for tying down electrical wires attached to the electrical wire end connectors, the enclosure having a front wall, a rear wall and opposite first and second side walls. The connector restraint device comprises an elongate wire support and tie-down angle having a horizontal leg and a vertical leg depending from the horizontal leg, each of the horizontal and vertical legs being formed having a number of closely spaced apertures along the legs, the apertures being sized for receiving conventional wire ties.

Included are means for detachably attaching the wire support and tie-down angle to the electrical equipment enclosure with the wire support and tie-down angle parallel to and spaced away from the enclosure wall in which said connectors are installed, with the horizontal leg parallel to the enclosure wall in which the connectors are installed at a height corresponding to said connectors so that electrical wires connected to the connectors can be extended generally horizontally over the horizontal leg. The wire support and tie-down angle is formed so that the vertical leg depends from an edge of the horizontal leg that is closest to the enclosure when the wire support and tie-down angle is attached to the enclosure.

Preferably, the wire support and tie-down angle has an overall width that is equal to that of the enclosure wall in which the connectors are installed. Also preferably, the horizontal and vertical legs of the wire support and tie-down angle have transverse widths between about 0.63 inch and about 0.75 inch.

In a preferred embodiment of the invention, the connectors are installed in the rear wall of the enclosure and the detachable attaching means attaches the wire support and tie-down angle spaced rearward about three inches from the enclosure rear wall.

It is preferred that the detachable attaching means include an elongate connector restraint device base portion to which the wire support and tie-down angle is joined and first and second elongate side flanges joined to opposite ends of the base portion, the side flanges being configured for lying along and attaching to respective ones of the first and second side walls of the enclosure.

The enclosure includes sidewardly extending equipment rack attachment angles at opposite side edges of the enclosure front wall; distal end regions of each of the first and second elongate side flanges are angled sidewardly so as to fit against corresponding ones of the enclosure equipment rack attachment angles.

The wire support and tie-down angle, the base portion and the first and second side flanges are preferably constructed from a structural material having a thickness of at least about 0.0598 inch.

Alternatively, the electrical connectors may be installed in the front wall of the equipment enclosure and the detachable attaching means is configured for attaching the wire support and tie-down angle spaced forward about three inches from the enclosure front wall.

The enclosure has sidewardly extending equipment rack attachment angles at opposite side edges of the front wall, and the detachable attaching means includes a connector restraint device base portion to which the wire support and tie-down angle is joined and first and second side flanges connected to opposite ends of the base portion with distal end regions of each of the first and second side flanges angled sidewardly so as to fit against corresponding ones of the enclosure equipment rack attachment angles.

The wire support and tie-down angle, base portion and the first and second side flanges are also preferably constructed from a structural material having a thickness of at least about 0.0598 inch.

More specifically, there is provided a rear-mount connector restraint device for restraining electrical wire end connectors plugged into connectors installed in a rear wall of an electrical equipment enclosure, and for tying down electrical wires attached to the electrical wire end connectors, the enclosure also having a front wall and opposite first and second side walls. The rear-mount connector restraint device comprises an elongate base portion and a wire support and tie-down angle joined to the base portion. The wire support and tie-down angle is formed having a horizontal leg and a vertical leg depending from the horizontal leg, each of the horizontal and vertical legs having a number of closely spaced quadrilateral, preferably square, apertures along the legs sized for receiving conventional wire ties.

Included are first and second elongate side flanges joined to opposite ends of the connector restraint device base portion, the side flanges being configured for lying along and attaching to respective ones of the enclosure first and second side walls with the wire support and tie-down angle parallel to and spaced rearward about three inches from the enclosure rear wall and with the horizontal leg parallel to said enclosure rear wall at a height corresponding to the connectors so that electrical wires connected to the connectors can be extended generally horizontally over the horizontal leg. The wire support and tie-down angle is formed so that the vertical leg of the angle depends from an edge of the horizontal leg that is closest to the enclosure rear wall when the angle is attached to the enclosure.

Preferably, the connector restraint device base portion and the wire support and tie-down angle have an overall width that is equal to that of the enclosure rear wall and the horizontal and vertical legs of the wire support and tie-down angle have transverse widths between about 0.63 inch and about 0.75 inch.

The enclosure has sidewardly extending equipment rack attachment angles at opposite side edges of the front wall; distal end regions of each of the first and second elongate side flanges are angled sidewardly so as to fit against corresponding ones of the enclosure equipment rack attachment angles.

It is preferred that the connector restraint device base portion, the wire support and tie-down angle and the first and second side flanges are constructed from a structural material having a thickness of at least about 0.0598 inch.

In a variation, there is provided a front-mount connector restraint device for restraining electrical wire end connectors plugged into connectors installed in a front wall of an electrical equipment enclosure, and for tying down electrical wires attached to said electrical wire end connectors, the enclosure also having a rear wall and opposite first and second side walls. The front-mount connector restraint device comprises an elongate base portion having joined thereto an elongate wire support and tie-down angle having a horizontal leg and a vertical leg depending from the horizontal leg, each of the horizontal and vertical legs being formed having a number of closely spaced apertures along the legs sized for receiving conventional wire ties.

Included are first and second side flanges joined to opposite ends of the connector restraint device base portion. The enclosure has sidewardly extending equipment rack attachment angles at opposite side edges of the front wall, and distal end regions of each of the first and second side flanges are angled sidewardly so as to fit against corresponding ones of the enclosure equipment rack attachment angles with the wire support and tie-down angle parallel to and spaced forward about three inches from the enclosure front wall and with the horizontal leg parallel to the enclosure front wall at a height corresponding to the connectors so that electrical wires connected to the connectors can be extended generally horizontally over the horizontal leg.

The wire support and tie-down angle is formed so that the vertical leg of the angle depends from an edge of the horizontal leg that is closest to the enclosure front wall when the angle is attached to the enclosure.

Preferably, the base portion and the wire support and tie-down angle have an overall width that is equal to that of the enclosure front wall and the horizontal and vertical legs of the wire support and tie-down angle have transverse widths between about 0.63 inch and about 0.75 inch. Also preferably, the base portion, the wire support and tie-down angle and the first and second side flanges are constructed from a structural material having a thickness of at least about 0.0598 inch.

Both the rear-mount and front-mount connector restraint devices are universal and cost effective devices that provide effective electrical wire end connector restraint and connecting wire management for electrical wires plugged into electrical equipment enclosure walls.

BRIEF DESCRIPTION OF THE DRAWINGS

The present invention can be more readily understood by a consideration of the following detailed description when taken in conjunction with the accompanying drawings, in which:

FIG. 4 is a series of drawings showing three views of the rear-mount connector restraint device of FIG. 1.

FIG. 6 is similar to FIG. 4, showing three views of variation front-mount connector restraint device generally corresponding to the rear-mount connector restraint device of FIG. 1, except that the variation front-mount connector restraint device is constructed with short side flanges for screw attachment to enclosure equipment attachment ears.

In the various FIGS., the same elements and features are given the same reference numbers and similar or corresponding elements and features are given the original reference number followed by an "a".

DESCRIPTION OF THE PREFERRED EMBODIMENT

Figure 1:
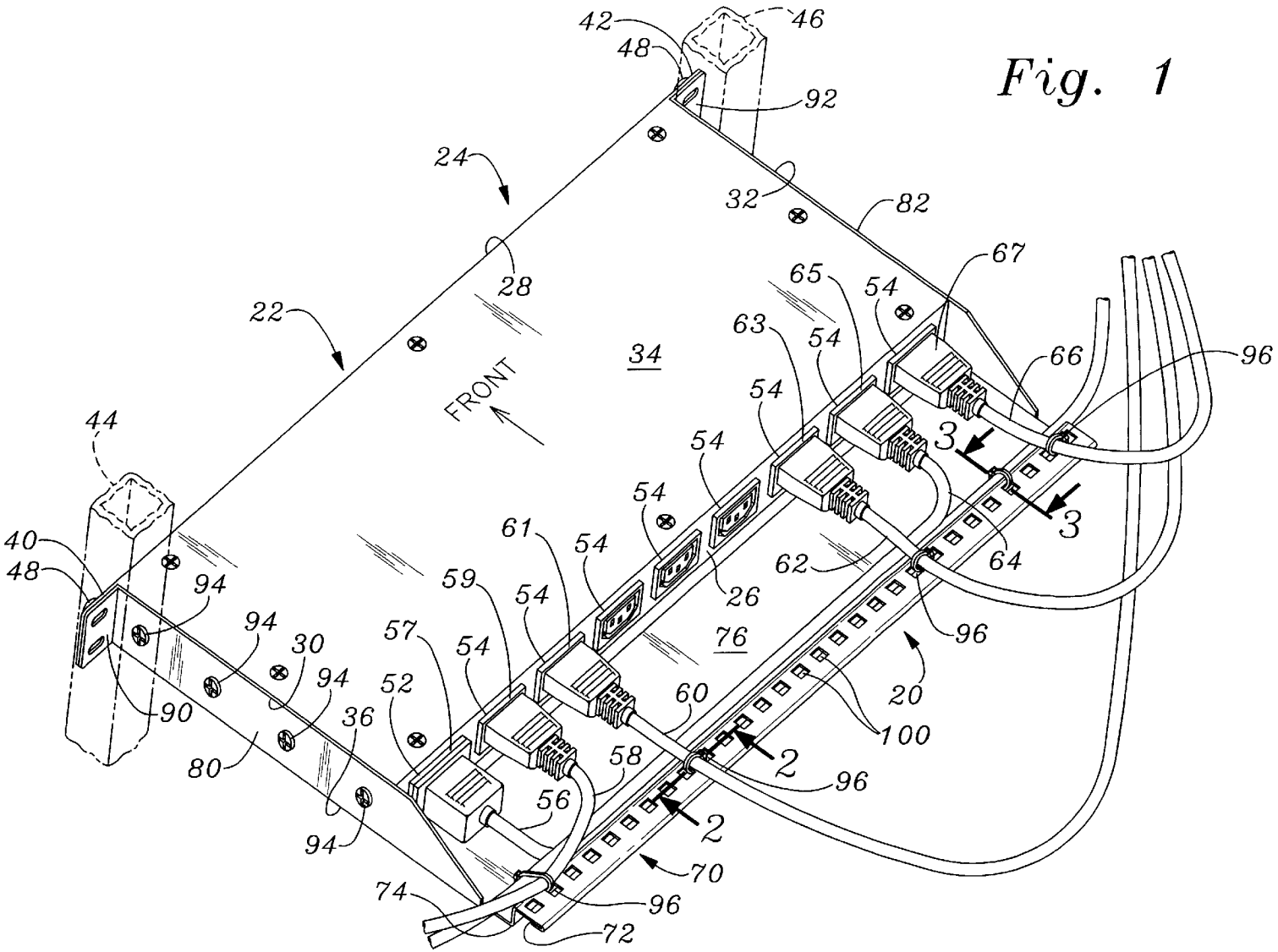
FIG. 1 is a perspective drawing of a representative AC power controller having a single AC power inlet connector and a row of eight IEC-type AC power outlet connector installed in an enclosure rear wall of the power controller, showing a rear-mount connector restraint device, in accordance with the present invention, attached to sides of the power controller enclosure and to rack mounting ears of the enclosure and projecting rearwardly from the enclosure rear wall, and further showing several representative power cords plugged into representative ones of the power connectors and secured by conventional cable ties to a perforated wire support and tie-down angle of the wire tray.

FIG. 1 depicts a rear-mount connector restraint device 20 (which may alternatively be refereed to as a wire tray) in accordance with a preferred embodiment of the present invention. It is to be appreciated that as used herein the word "wire" is intended to include all types of electrical wires, cables and power cords.

Rear-mount connector restraint device 20 is shown attached, as more particularly described below, to an enclosure 22 of an existing piece of electrical equipment 24 to extend rearwardly from an enclosure rear wall 26. Enclosure 22 includes a front wall 28, opposite first and second side walls 30 and 32, respectively, a detachable cover panel 34 and a bottom 36.

As depicted, enclosure 22 is conventionally installed by ears 40 and 42, projecting sidewardly from respective enclosure side walls 30 and 32 at corners of front wall 28, into a conventional equipment rack represented by first and second vertical rack members 44 and 46 (shown in phantom lines). To this end, four screws 48 are used to attach enclosure ears 40 and 42 to respective first and second equipment rack vertical members 44 and 46.

For illustrative purposes only, with no limitation being thereby intended or implied, electrical equipment 24 is depicted in FIG. 1 as a model TCP 884-1 power controller manufactured by Pulizzi Engineering Inc., of Santa Ana, Calif. In keeping with such illustrative example, enclosure rear wall 26 is shown relatively narrow, having installed therein a single, grounded male AC power inlet connector 52 and (by way of example) a row of eight closely-spaced, grounded IEC female AC power outlet connectors 54.

A power cord or cable 56, having a three recess, female plug-in end connector 57, is shown plugged into AC power inlet connector 52 for supplying electrical power to equipment 24 from an external power source (not shown), such as a power strip or wall outlet. By way of further example, five electric cords or cables, 58, 60, 62, 64 and 66, having corresponding three pin plug-in end connectors 59, 61, 63, 65 and 67, are shown separately plugged into five associated AC power outlet connectors 54 for supplying electric power from equipment 24 to other external electrical equipment (not shown). It is, of course, to be appreciated that other types of electrical wires, for example, RS 232 control wires (not shown), may be associated with other types of electrical equipment and connectors.

It is to be appreciated that the connector restraint provided by connector restraint device 20 relates to constraining power cord end connectors 57–67 that are plugged into respective enclosure-installed connectors 52 and 54 to remain plugged in against unintentional unplugging. Such constraint is provided, as more particularly described below, by securing power cords 56–56 to connector restraint device 20 relatively close to the enclosure-installed connectors 52 and 54. In addition, such power cord tie-down provides for the management and "dressing" of power cords 56–66 (or other connecting wires) in an orderly manner.

Shown in FIG. 1 comprising rear-mount connector restraint device 20 is an elongate, transverse wire support and tie-down angle or angular portion 70 that is shown formed as an angle having a relatively narrow, perforated horizontal leg 72 and a relatively narrow, perforated vertical leg 74 that depends from a forward region of the horizontal leg (the forward direction being indicated on FIG. 1). Wire support and tie-down angle 70 projects upwardly from a transverse base or stiffener portion 76 and extends parallel to, and preferably across the entire width of, enclosure rear wall 26.

Respective first and second enclosure-attaching side flanges or rails 80 and 82 extending forwardly away from connector restraint device angle 70 from opposite side regions of base portion 76. Side flanges 80 and 82 are configured to extend completely along respective first and second side walls 30 and 32 of enclosure 22 so as to mount wire support and tie-down angle 70 spaced rearward from and parallel to enclosure rear wall 26 with vertical leg 74 depending from an edge of horizontal leg 72 that is closest to the enclosure rear wall.

For detachable attachment of rear-mount connector restraint device 20 to enclosure 22, first and second connector restraint device attachment ears 90 and 92 formed on respective side flanges 80 and 82 project sidewardly at distal ends of the flanges so as to abut against respective enclosure ears 40 and 42. Connector restraint device ears 90 and 92 are detachably fastened to enclosure ears 40 and 42 and to vertical rack members 44 and 46 by screws 48 when equipment 24 is installed in the equipment rack represented by the rack members.

Detachable attachment of rear-mount connector restraint device 20 to enclosure 22 is also achieved by screws 94 that extend through connector restraint device side flanges 80 and 82 into respective enclosure side walls 30 and 32 (shown in FIG. 1 only for first flange 80 is a row of four spaced-apart screws 94). By use of screws 94, rear-mount connector restraint device 20 may advantageously be attached to equipment enclosure 22 before equipment 24 is installed in the equipment rack and is mounted to rack members 44 and 46.

As depicted in FIG. 1, wire support and tie-down angle 70 is configured so that vertical leg 74 depends from an edge of horizontal leg 72 that is closest to enclosure rear wall 26 when rear-mount connector restraint device 20 is installed on enclosure 22 in the manner described above.

Rear-mount connector restraint device 20 is constructed and installed, as above described, on equipment enclosure 22 so that representative electric cords 56–66 (and all other electrical cords or other types of electrical wires or cables that are subsequently connected to the enclosure-installed connectors 52 and 54 or to other corresponding types of enclosures and connectors) are routed, as depicted in FIG. 1 for power cords 56 and 64, along vertical leg 72 of connector restraint device angle 70 or, as depicted for power cords 58, 60 62 and 66, along or across horizontal leg 72.

Figure 3:
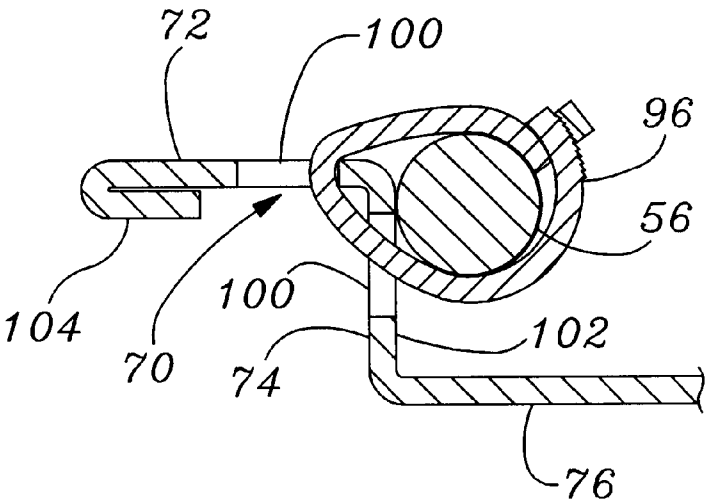
FIG. 3 is a horizontal cross sectional view looking along line 3—3 of FIG. 1, showing another representative one of the electrical power cords tied down by a conventional plastic cable tie to a vertical leg of the wire tray angle, and showing the cable tie extending through two adjacent angle perforations in the vertical and horizontal legs of the angle and over the representative power cord.
Figure 2:
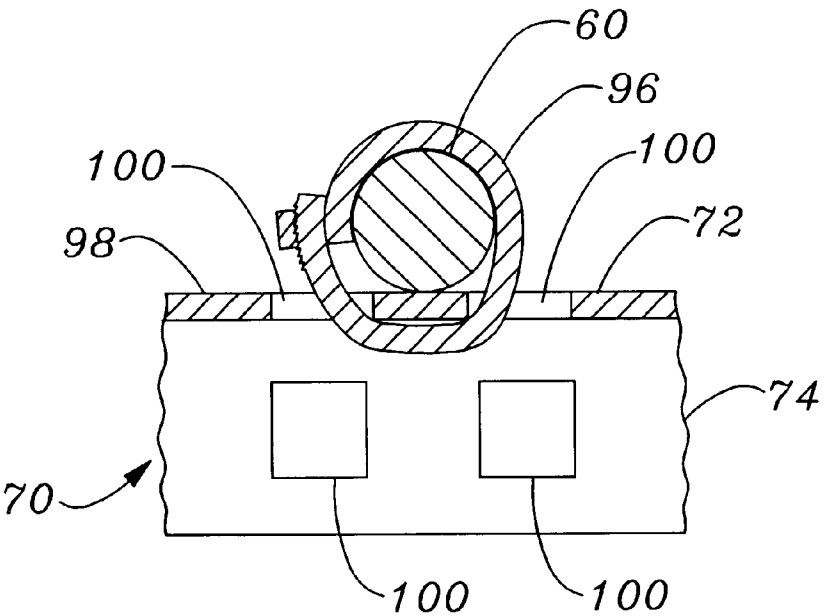
FIG. 2 is a horizontal cross sectional view looking along line 2—2 of FIG. 1, showing a representative one of the electrical power cords tied down by a conventional plastic cable tie to a horizontal leg of the connector restraint device angle, and showing the cable tie extending through two adjacent angle perforations and over the representative power cord.

Representative power cords 56–66 are shown detachably secured to connector restraint device angle horizontal and/or vertical legs 72 or 74, as by use of conventional adjustable plastic (for example, nylon) wire ties 96 (as depicted in FIGS. 1, 2 and 3) or by the use of alternative types of ties. As shown in the cross sectional view of FIG. 2, by way of example, representative power cord 60 is detachably secured to an upper surface 98 of connector restraint device horizontal leg 72 by a tie 96 that extends through adjacent horizontal leg holes 100 and up and over the power cord. As shown in the cross sectional view of FIG. 3, by way of further example, representative power cord 56 is detachably secured to a forward surface 102 of connector restraint device vertical leg 74 by a tie 96 that extends through adjacent horizontal and vertical leg holes 100 and around the power cord.

By providing closely spaced holes 100 in both horizontal and vertical legs 72 and 74, sidewardly-routed power cords, for example, depicted power cords 56 and 64, can be tied down along the vertical leg while outwardly-routed power cords, for example, depicted power cords 58, 60, 62 and 66, can be tied down where they extend along or across the horizontal leg. This angle tie-down structure provides two cord tie down surfaces 98 and 102 (FIGS. 2 and 3) at right angles to one another so as to provide separation of power cords 56–66 and eliminate the possibility that any of the power cords could cut into any other power cord when they are tied down to connector restraint device angle 70.

Also shown in FIG. 3 is a bent-under lip 104 at the free end of horizontal leg 72. Lip 104 provides stiffening to horizontal leg 72 and eliminates a sharp exposed edge of the horizontal leg which otherwise might cut into power cords, such as power cords 60, 62 and 66 (FIG. 1), that cross over the horizontal leg. Connector restraint device base portion 76 provides rigidity to support and tie-down angle 70.

FIG. 4 shows, in three views, further details of rear-mount connector restraint device 20 in connection with equipment enclosure 22 (shown in phantom lines). It is, however, to be understood that although specific details and dimensions are given by way illustrating how rear-mount connector restraint device 20 can be constructed to advantage, the present invention is not limited to such details and dimensions.

Figure 4B:
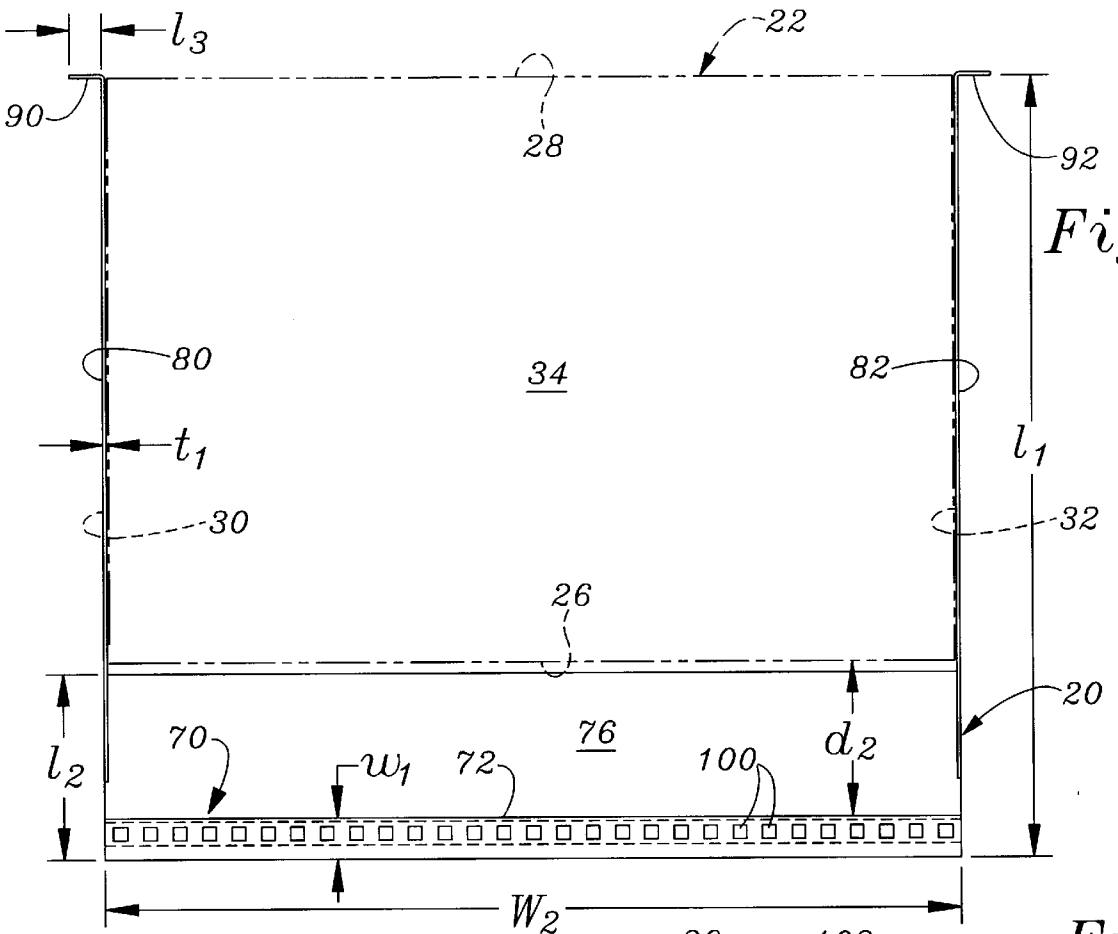
FIG. 4B being a plan view of the rear-mount connector restraint device, showing the horizontal leg of the angle and perforations therein, and showing in phantom lines part of the representative power control equipment of FIG. 1.
Figure 4A:
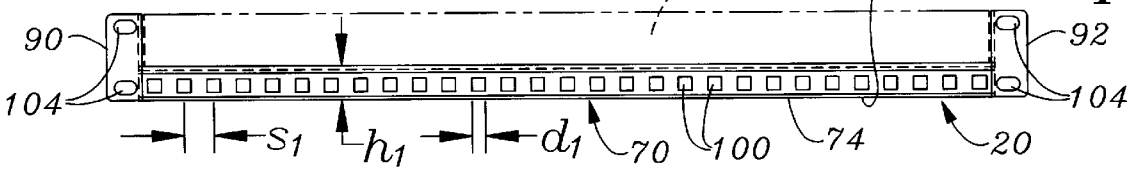
FIG. 4A being a rear elevation view of the rear-mount connector restraint device, showing the vertical leg of the angle and perforations therein and showing in phantom lines part of the representative power control equipment of FIG. 1.

FIG. 4A is an elevation view showing a row of 29 quadrilateral tie-down holes 100 formed in connector restraint device vertical leg 74 that is elevated a height, $h_1$, of about 0.634 inch, above a tray lower surface 102. Holes 100 have a uniform center to center spacing, $S_1$, that is preferably about 0.587 inch. Quadrilateral holes 100 are preferably square with side dimensions, $d_1$, that are preferably about 0.250 inch.

As shown in FIG. 4B, connector restraint device horizontal leg 72 is formed the same as vertical leg 74 having a like number of same sized and spaced preferably square holes 100 and having a transverse width, $w_1$, that may be only about 0.752 inch.

As a result of holes 100 being closely spaced in both horizontal and vertical legs 72 and 74, respectively, virtually any arrangement of connectors, such as connectors 52 and 54, and connecting wires, such as power cords 56–66, can be accommodated by connector restraint device 20. Moreover, since side edges of holes 100 are straight, as opposed to being arcuate, conventional nylon cable ties-having rectangular cross sections can be drawn through holes 100 and tightened in securing cords 56–66 without nicking or notching side edges of the ties that can result in subsequent breaking of the ties.

Connector restraint device angle 70 is shown having an overall (i.e., side-to-side) width, $w_2$, that is preferably the same as the standard side-to-side width of enclosure rear wall 26, and therefore may be about 17.550 inches.

FIG. 4B shows that connector restraint device side flanges 80 and 82 extend entirely along respective side walls 30 and 32 of enclosure 22, connector restraint device 20 thus having an overall length, $l_1$, that is preferably about 13.127 inches. Connector restraint device base portion 76 in combination with wire tie-down angle 70, has a length $l_2$, that is preferably about 3.625 inches, which spaces the wire support and tie-down angle a distance, $d_2$, of about three inches rearward of enclosure rear wall 26.

Attachment ears 90 and 92 at distal ends of side flanges 80 and 82 have 90 degree sidewardly extending lengths, $\mathbf{l}_3$, of about 0.73 to about 1.0 inch. Two holes 104 (FIG. 4B) are formed in each of side flange ears 90 and 92 to match equipment rack mounting holes (not specifically shown) in existing enclosure ears 40 and 42 for enclosure installation screws 48 (FIG. 1).

Rear-mount connector restraint device 20 is formed from a strong, rigid structural material, such as cold rolled steel, hard aluminum or a hard plastic, for example PVC, a polycarbonate or a polyolefin, having a thickness, $t_1$, of at least about 16 gauge (0.0598 inch). Device 20 may advantageously be formed from a single flat sheet of the structural material, or in the case of a plastic material may be injected or otherwise molded. Alternatively, device 20 may be constructed by joining separate pieces of the device together, as by welding, cementing, or by the use of screws, bolts, rivets, or other known fasteners and fastening techniques.

Figure 4C:
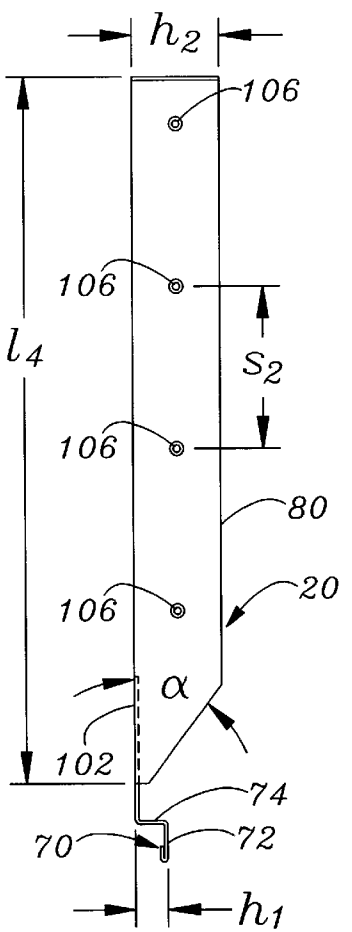
FIG. 4C being a side elevation view of the rear-mount connector restraint device, showing features of the elongate enclosure side wall attachment flanges and showing in phantom lines part of the representative power control equipment of FIG. 1.

Shown in side view in FIG. 4C, height, $h_1$, of horizontal leg 72 of connector restraint device angle 70 above under surface 102 of base portion 76 positions the horizontal leg at the height of representative power cords 58, 60, 62 and 66 as they extend straight out from enclosure rear wall 26 (FIG. 1).

Side flange 80, which is representative of both side flanges 80 and 82, is shown having a height, $h_2$, which may be about 1.659 to about 1.719 inch above under surface 102 (which is also the height of attachment ears 90 and 92). Side flanges 80 and 82 each have a preferred overall length, $l_4$, of about 11.928 inches; a rearward end region of each side flange being shown beveled at an angle, $\alpha$, of about 45 degrees to avoid sharp exposed corners. A row of four enclosure side wall attachment holes 106 for receiving screws 94 (FIG. 1) are formed in each side flange 80 and 82 at a uniform spacing, $s_2$, of about 2.50 inches.

Alternatively, rear-mount connector restraint device 20 could be made as an integral part of an associated enclosure 22 when the enclosure is constructed, in which case connector restraint device side flanges or rails 80 and 82 could be replaced by rearwardly-extending enclosure side walls 30 and 32, or could be eliminated by forming base portion 76 and wire support and tie-down angle 70 as a rearward extension of enclosure bottom 36.

FRONT MOUNT VARIATION CONNECTOR RESTRAINT DEVICE OF FIGS. 5 AND 6

Electrical equipment, particularly electrical equipment intended for being installed in an equipment rack, is almost universally constructed as described above for equipment 24 having connectors 52 and 54 installed in an enclosure rear wall 26 (FIG. 1). Thus, when the equipment is attached to equipment rack members 44 and 46, the various cords represented by cords 56–66 are conveniently out of the way and out of sight at the back of the equipment rack. This also generally provides a more orderly and less cluttered installation of electrical equipment in the rack. To this end rear-mount connector restraint device 20 is attached, as depicted in FIGS. 1 and 4 and as is described above, to sides 30 and 32 of equipment enclosure 22 to project to the rear of enclosure rear wall 26.

Nevertheless, sometimes a customer requires that alternative electrical equipment 24*a* (depicted in FIGS. 5 and 6) have connectors 52 and 54 (FIG. 5) installed in a front wall 28*a*, instead of a rear wall 26*a* of an enclosure 22*a*. This requires that electrical cord or wire connections be made to the front instead of to the rear of the equipment. For convenient descriptive purposes only, with no limitation being thereby intended or implied, alternative equipment 24*a* is otherwise identical to above-described equipment 24; it is to be understood, however, that this may not usually be the actual case.

Figure 5:
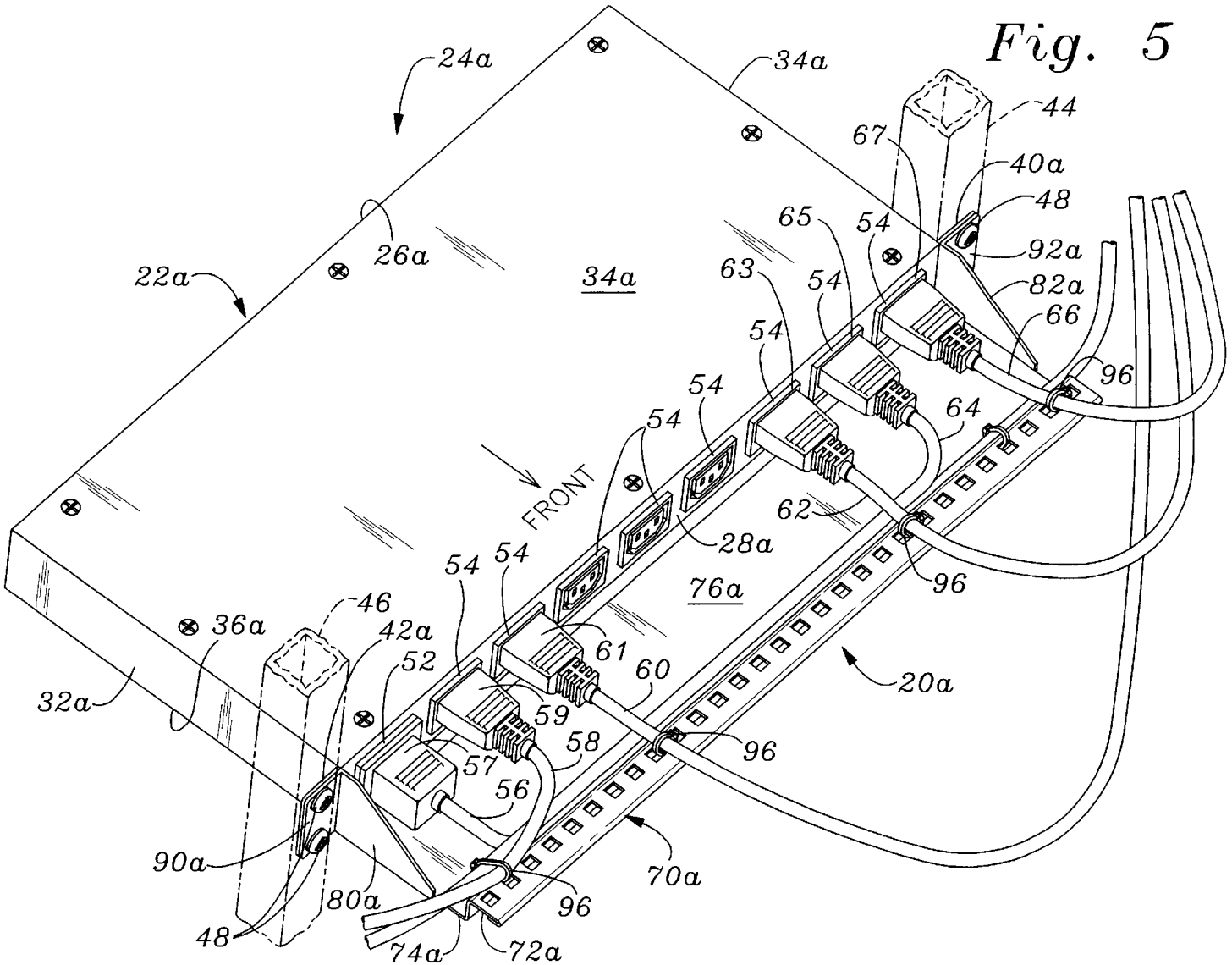
FIG. 5 is a perspective drawing similar to FIG. 1, showing a representative AC power controller having a single AC power inlet connector and a row of eight IEC-type AC power outlet connector installed in an enclosure front wall, showing a variation, front-mount connector restraint device attached to rack mounting ears of the enclosure and projecting in front of the enclosure front wall, and further showing several representative power cords plugged into representative ones of the power connectors and secured by conventional cable ties to a perforated wire support and tie-down angle of the connector restraint device.
Figure 6B:
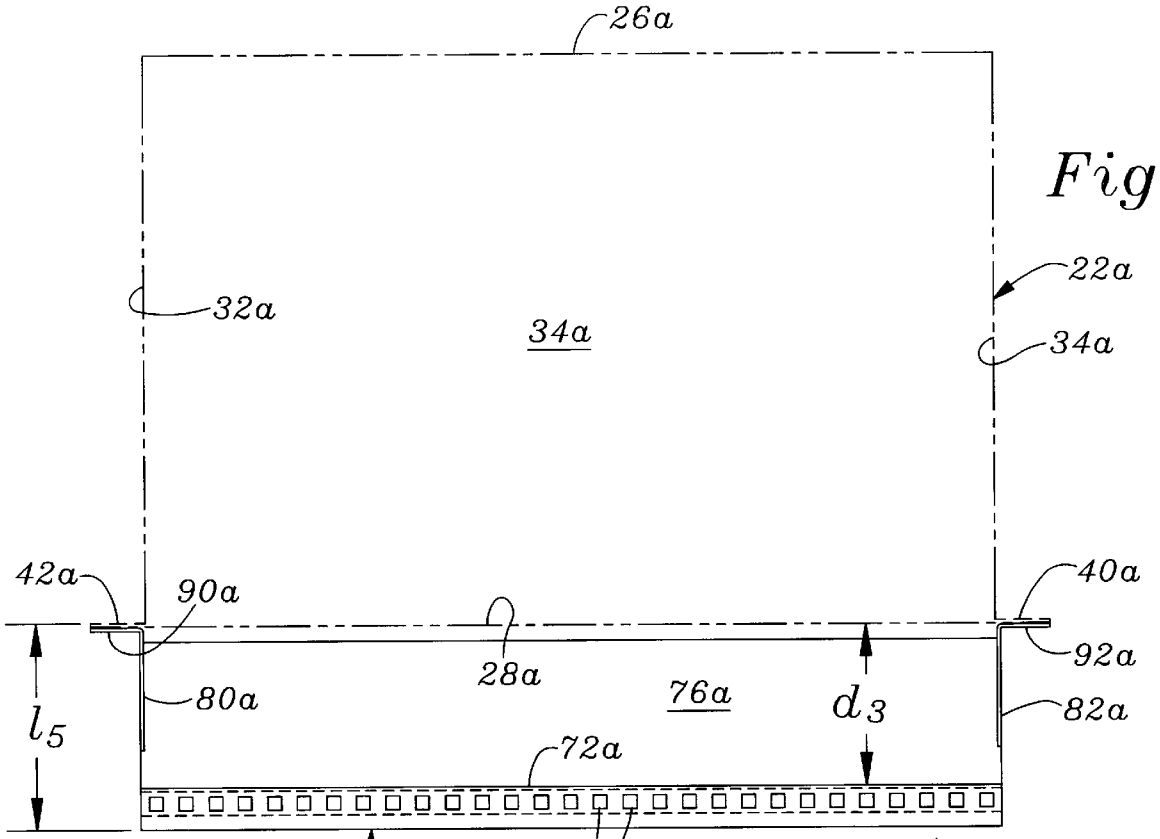
FIG. 6B being a plan view of the variation, front-mount connector restraint device, showing the horizontal leg of the angle and perforations therein, and showing in phantom lines part of the representative power control enclosure to which the variation connector restraint device is attached.
Figure 6A:
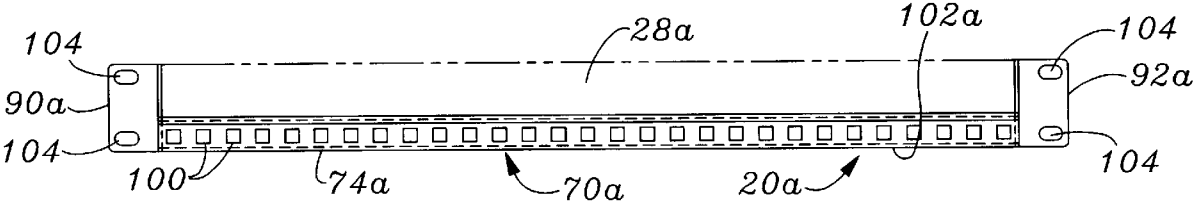
FIG. 6A being a rear elevation view of the variation front-mount connector restraint device, showing the vertical leg of the angle and perforations therein and showing in phantom lines part of a representative power control enclosure corresponding generally to that depicted in FIG. 1, and to which the variation, front-mount connector restraint device is attached.

For such alternative equipment 24*a* having above-described connectors 52 and 54 installed in an enclosure front wall 28*a*, a variation, front-mount connector restraint device 20*a* is provided (FIGS. 5 and 6).

As seen from a comparison of FIG. 5 with FIG. 1 and of FIG. 6 with FIG. 4, front-mount connector restraint device 20*a* is, for purposes of description herein, depicted as constructed to be identical to rear-mount connector restraint device 20, except that respective first and second side flanges 80*a* and 82*a*, which are joined to opposite ends of base portion 76*a* of the front-mount connector restraint device, are substantially shorter that corresponding first and second side flanges 80 and 82 of rear-mount connector restraint device 20. This is dictated by the manner in which both equipment 24 and 24*a* are installed in an equipment rack represented by vertical rack members 44 and 46.

The shorter side flanges 80*a* and 82*a* of front-mount connector restraint device 20*a* enable the detachable attachment of front-mount connector restraint device ears 90*a* and 92*a* at distal ends of short side flanges 80*a* and 82*a* by four screws 48 to respective enclosure mounting ears 42*a* and 40*a* at corners of enclosure front wall 28*a*, and thereby to respective equipment rack members 46 and 44 when equipment 24*a* is installed in the equipment rack.

Short side flanges 80*a* and 82*a* of front-mount connector restraint device 20*a* preferably have lengths, $\mathbf{1}_6$, (FIG. 6C) that space wire support and tie-down angle 70*a* the same distance from front wall 28*a* of enclosure 22*a* as corresponding wire support and tie-down angle 70 of rear-mount connector restraint device 20 is spaced from rear wall 26 of enclosure 22 by side flanges 80 and 82.

As depicted in FIG. 5, wire support and tie-down angle 70*a* is configured so that vertical leg 74*a* depends from an edge of horizontal leg 72*a* that is closest to enclosure front wall 28*a* when front-mount connector restraint device 20*a* is installed on enclosure 22*a* in the manner described above.

Representative power cords 56–66, with associated end connectors 57–67, are tied down to horizontal and vertical legs 72*a* and 74*a* of angle 70*a* of front-mount connector restraint device 20*a* by conventional wire ties 96 in the same manner as depicted (FIGS. 1–3) and above-described for rear-mount connector restraint device 20.

Figure 6C:
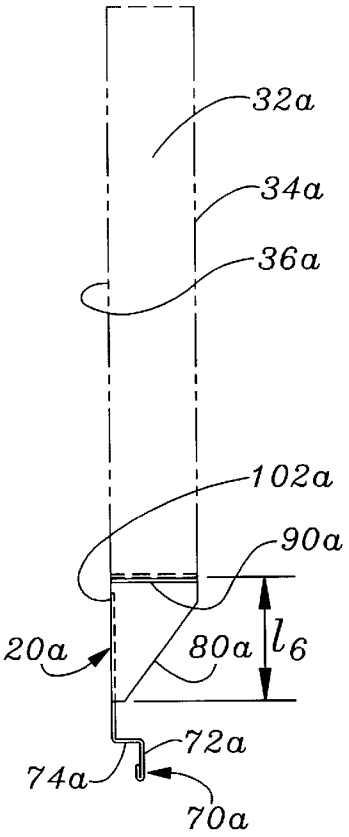
FIG. 6C being a side elevation view of the variation, front-mount connector restraint device, showing features of the attachment flanges and showing in phantom lines part of the representative power control enclosure to which the variation front-mount connector restraint device is attached.

FIG. 6 provides, in three views, more details of front-mount connector restraint device 20*a* that is shown in connection with equipment enclosure 22*a* (shown in phantom lines). As is shown in the top view of FIG. 6B and the side view of FIG. 6C, the only differences between front-mount connector restraint device 20*a* and rear-mount connector restraint device 20 are an overall length, $l_5$, of the front-mount connector restraint device, which may be about 3.795 inches, which spaces wire support and tie-down angle 70*a* a distance, $d_3$, of about three inches forward of enclosure front wall 28*a*. A length, $l_6$, of side flanges or rails 80*a* and 82*a* may be about 2.296 inches.

From the foregoing, it will be appreciated that rear-mount connector restraint device 20 and front-mount connector restraint device 20*a* can readily be detachably attached to preexisting equipment enclosures, such as enclosures 22 and 22*a*.

Alternatively, front-mount connector restraint device 20*a* could be made as an integral part of an associated enclosure 22 when the enclosure is constructed, in which case connector restraint device base portion 76*a* and wire support and tie-down angle 70*a* could be formed as a forward extension of enclosure bottom 36*a*.

Rear-mount connector restraint device 20 and front-mount connector restraint device 20*a* provide universal connector restraint for electrical equipment enclosures, as well as universal connector wire management for such enclosures in a convenient manner and at a relatively low cost.

Although there have been described above a rear-mount connector restraint device and a variation, front-mount connector restraint device in accordance with the present invention for purposes of illustrating the manner in which the present invention maybe used to advantage, it is to be understood that the invention is not limited thereto. Consequently, any and all variations and/or equivalent arrangements which may occur to those skilled in the applicable art are to be considered to be within the scope and spirit of the invention as set forth in the claims which are appended hereto as part of this application.

What is claimed is:

1. A connector restraint device for restraining electrical end connectors and electrical wires attached thereto, said connector restraint device comprising:

a. an electrical equipment enclosure having front, back and opposing, first and second side walls, and having a plurality of electrical connectors installed in one enclosure wall for receiving electrical connecting wires;

b. an elongate wire support and tie-down angle having a horizontal leg and a vertical leg depending from the horizontal leg, each of said horizontal and vertical legs being formed having a number of closely spaced apertures along said legs, said apertures being sized for receiving conventional wire ties; and c. means for detachably attaching said wire support and tie-down angle to said electrical equipment enclosure, with said wire support and tie-down angle spaced away from said enclosure wall in which said connectors are installed and with said horizontal leg parallel to said enclosure wall in which said connectors are installed at a height corresponding to said connectors so that said electrical wires connected to said electrical connectors can be extended generally horizontally over said horizontal leg.

2. The connector restraint device as claimed in claim 1, wherein said wire support and tie-down angle is formed so that said vertical leg depends from an edge of said horizontal leg that is closest to said enclosure when said angle is attached to said electrical equipment enclosure.

3. The connector restraint device as claimed in claim 1, wherein said wire support and tie-down angle has an overall width that is equal to an overall width of said enclosure wall in which said connectors are installed.

4. The connector restraint device as claimed in claim 1, wherein said wire tie apertures in said horizontal and vertical legs are quadrilateral in shape.

5. The connector restraint device as claimed in claim 1, wherein said wire tie apertures in said horizontal and vertical legs are square in shape.

6. The connector restraint device as claimed in claim 1, wherein said horizontal and vertical legs of said wire support and tie-down angle have transverse widths between about 0.63 inch and about 0.75 inch.

7. A rear-mount connector restraint device for restraining electrical end connectors and electrical wires attached thereto said rear-mount connector restraint device comprising:

a. an electrical equipment enclosure having front, back and opposing, first and second side walls, and having a plurality of electrical connectors installed in said rear wall for receiving electrical connecting wires;

b. a connector restraint device base portion;

c. an elongate wire support and tie-down angle having a horizontal leg and a vertical leg depending from the horizontal leg, each of said horizontal and vertical legs being formed having a number of closely spaced quadrilateral apertures along legs, said apertures being sized for receiving conventional wire ties; said wire support and tie-down angle being joined to said base portion; and d. first and second elongate side flanges joined to opposite ends of said base portion, said side flanges being configured for lying along and attaching to respective ones of said first and second side walls with said wire support and tie-down angle parallel to and spaced rearward about three inches from said enclosure rear wall and with said horizontal leg parallel to said enclosure rear wall at a height corresponding to said connectors so that electrical wires connected to said connectors can be extended generally horizontally over said horizontal leg, said wire support and tie-down angle being formed so that said vertical leg depends from an edge of said horizontal leg that is closest to said enclosure rear wall when said angle is attached to said electrical equipment enclosure.

8. The rear-mount connector restraint device as claimed in claim 7, wherein said wire support and tie-down angle has an overall width that is equal to an overall width of said enclosure rear wall and wherein said horizontal and vertical legs of said wire support and tie-down angle have transverse widths between about 0.63 inch and about 0.75 inch.

9. The rear-mount connector restraint device as claimed in claim 7, wherein said enclosure includes sidewardly extending equipment rack attachment angles at opposite side edges of said enclosure front wall, and wherein distal end regions of each of said first and second elongate side flanges are angled sidewardly so as to fit against corresponding ones of said enclosure equipment rack attachment angles.

10. The connector restraint device as claimed in claim 7, wherein said base portion, said wire support and tie-down angle and said first and second side flanges are constructed from a structural material having a thickness of at least about 0.0598 inch.

11. A front-mount connector restraint device for restraining electrical end connectors and electrical wires attached thereto said front-mount connector restraint device comprising:

a. an electrical equipment enclosure having front, back and opposing, first and second side walls, and having a plurality of electrical connectors installed in said front wall for receiving electrical connecting wires;

b. a connector restraint device base portion;

c. an elongate wire support and tie-down angle having a horizontal leg and a vertical leg depending from the horizontal leg, each of said horizontal and vertical legs being formed having a number of closely spaced quadrilateral apertures along said legs, said apertures being sized for receiving conventional wire ties, said wire support and tie-down angle being joined to said base portion; and d. first and second side flanges joined to opposite ends of said connector restraint device base portion, said enclosure having sidewardly extending equipment rack attachment angles at opposite side edges of the front wall, distal end regions of each of said first and second elongate side flanges being angled sidewardly so as to fit against corresponding ones of said enclosure equipment rack attachment angles with said wire support and tie-down angle parallel to and spaced forward about three inches from said enclosure front wall and with said horizontal leg parallel to said enclosure front wall at a height corresponding to said connectors so that electrical wires connected to said connectors can be extended generally horizontally over said horizontal leg, said wire support and tie-down angle being formed so that said vertical leg depends from an edge of said horizontal leg that is closest to said enclosure front wall when said angle is attached to said electrical equipment enclosure.

12. The front-mount connector restraint device as claimed in claim 11, wherein said wire support and tie-down angle has an overall width that is equal to an overall width of said enclosure front wall and wherein said horizontal and vertical legs of said wire support and tie-down angle have transverse widths between about 0.63 inch and about 0.75 inch.

13. The front-mount connector restraint device as claimed in claim 11, wherein said base portion, said wire support and tie-down angle and said first and second side flanges are constructed from a structural material having a thickness of at least about 0.0598 inch.

14. A connector restraint device for restraining electrical end connectors and electrical wires attached thereto, said connector restraint device comprising:

a. an electrical equipment enclosure having front, back and opposing, first and second side walls, and having a plurality of electrical connectors installed in said rear wall for receiving electrical connecting wires;

b. an elongate wire support and tie-down angle having a horizontal leg and a vertical leg depending from the horizontal leg, each of said horizontal and vertical legs being formed having a number of closely spaced apertures along said legs, said apertures being sized for receiving conventional wire ties; and c. means for detachably attaching said wire support and tie-down angle to said electrical equipment enclosure, with said wire support and tie-down angle spaced away from said enclosure rear wall and with said horizontal leg parallel to said rear wall and at an elevation causing electrical wires connected to said electrical connectors to extend generally horizontally over said horizontal leg, said attaching means attaching said wire support and tie-down angle spaced rearward about three inches from said enclosure rear wall.

15. The connector restraint device as claimed in claim 14 wherein said connector restraint device includes an elongate base portion, wherein said wire support and tie-down angle is joined to said connector restraint device base portion and wherein said detachable attaching means includes first and second elongate side flanges joined to opposite ends of said connector restraint device base portion, said side flanges being configured for lying along and attaching to respective ones of said first and second side walls of said enclosure.

16. The connector restraint device as claimed in claim 15, wherein said enclosure includes sidewardly extending equipment rack attachment angles at opposite side edges of said front wall, and wherein distal end regions of each of said first and second elongate side flanges are angled sidewardly so as to fit against corresponding ones of said enclosure equipment rack attachment angles.

17. The connector restraint device as claimed in claim 15, wherein said base portion, said wire support and tie-down angle and said first and second side flanges are constructed from a structural material having a thickness of at least about 0.0598 inch.

18. A connector restraint device for restraining electrical end connectors and electrical wires attached thereto, said connector restraint device comprising:

a. an electrical equipment enclosure having front, back and opposing, first and second side walls, and having a plurality of electrical connectors installed in said front wall for receiving electrical connecting wires;

b. an elongate wire support and tie-down angle having a horizontal leg and a vertical leg depending from the horizontal leg, each of said horizontal and vertical legs being formed having a number of closely spaced apertures along said legs, said apertures being sized for receiving conventional wire ties; and c. means for detachably attaching said wire support and tie-down angle to said electrical equipment enclosure, with said wire support and tie-down angle spaced forwardly away from said enclosure front wall and with said horizontal leg parallel to said front wall and at an elevation causing electrical wires connected to said electrical connectors to extend generally horizontally over said horizontal leg.

19. The connector restraint device as claimed in claim 18, wherein said detachable attaching means attaches said wire support and tie-down angle about three inches forward of said enclosure front wall.

20. The connector restraint device as claimed in claim 18, wherein said connector restraint device includes an elongate base portion, wherein said support and tie-down angle is joined to said connector restraint device base portion, wherein said enclosure is formed having sidewardly extending equipment rack attachment angles at opposite side edges of the front wall, and wherein said detachable attaching means includes first and second side flanges connected to opposite ends of said connector restraint device base portion, distal end regions of each of said first and second side flanges being angled sidewardly so as to fit against corresponding ones of said enclosure equipment rack attachment angles.

21. The connector restraint device as claimed in claim 20, wherein said base portion, said wire support and tie-down angle and said first and second side flanges are constructed from a structural material having a thickness of at least about 0.0598 inch.

* * * * *